US006612205B1

(12) United States Patent
Jones

(10) Patent No.: US 6,612,205 B1
(45) Date of Patent: Sep. 2, 2003

(54) RATCHET

(76) Inventor: Darwin Jones, 344 Private Dr., Falmouth, KY (US) 41040

( * ) Notice: Subject to any disclaimer, the term of this patent is extended or adjusted under 35 U.S.C. 154(b) by 0 days.

(21) Appl. No.: 10/100,890

(22) Filed: Mar. 19, 2002

(51) Int. Cl.[7] ..... B25B 13/46

(52) U.S. Cl. ..... 81/63.1; 81/62; 81/59.1; 192/43.1

(58) Field of Search ..... 81/60, 61, 62, 81/63, 63.1, 63.2, 58.2, 59.1; 192/43, 44, 45, 43.1, 45.1, 43.2

(56) References Cited

U.S. PATENT DOCUMENTS 1,032,871 A * 7/1912 Bancroft ..... 81/62
1,053,703 A * 2/1913 Bonine ..... 81/62
1,372,453 A * 3/1921 Radford ..... 81/59.1
2,735,324 A * 2/1956 Goldwater et al. ..... 81/60
2,943,523 A * 6/1960 Gary et al. ..... 81/63
2,978,081 A * 4/1961 Lundin ..... 8/63
4,561,329 A * 12/1985 Lack ..... 81/62
5,417,129 A * 5/1995 Baron ..... 81/58.2
5,501,124 A * 3/1996 Ashby ..... 81/58.2
6,006,633 A * 12/1999 Kaiser et al. ..... 81/387
6,101,902 A * 8/2000 Wei ..... 81/63
6,164,166 A * 12/2000 Whiteford ..... 81/60
6,164,167 A 12/2000 Chen
6,308,594 B1 10/2001 Chen
6,345,559 B1 2/2002 Wang
6,405,618 B1 * 6/2002 Sorensen et al. ..... 81/177.4

* cited by examiner

*Primary Examiner*—Joseph J. Hail, III
*Assistant Examiner*—Hadi Shakeri
(74) *Attorney, Agent, or Firm*—R. William Graham

(57) ABSTRACT

A ratchet includes a handle and a head, the head has an open receiving surface wherein an insert is disposed therein and of a size smaller than the open receiving surface. A portion of the open receiving surface includes a bearing surface against which the insert rotates, the insert configured for engaging a conventional head of bolt or the like. A movable stop is disposed within another portion of the open receiving surface adjacent the insert and the bearing surface in a manner such that when the insert is caused to rotate in one direction relative to the bearing surface the stop is frictionally drawn into lodging engagement with the insert and bearing surface to preclude further rotation of the insert and fixably secure relative position between the insert and the bearing surface whereby the rotation of the threaded member is effected and when the insert is caused to rotate in an opposite direction, the stop is driven into a dislodged position.

7 Claims, 2 Drawing Sheets

RATCHET

BACKGROUND OF THE INVENTION

1. Field of the Invention

The present invention relates to a ratchet having an improved driving member which also incorporates a labor saving design. More particularly, the ratchet has a simplified drive head having a rotatable insert and an improved stop mechanism.

2. Description of the Related Prior Art

Conventional ratchet wrenches continue to need improvement in their durability and utility. Recently, the prior art focused on a labor saving structure in which the operator avoided exerting a large force to drive the handle to achieve the purpose of releasing or locking the workpiece, such as in U.S. Pat. No. 6,308,594. The present invention also aims to achieve this goal.

In doing so, however, the prior ratchet wrenches exhibit failure due to the rather weak locking mechanisms. Further, such prior ratchets are limited in torque by their locking mechanism. When confronted with a tight spot and well locked threaded member, the operator has to exert a large force for driving the handle which in turn applies significant force on the internal locking members of the head and due to their design are more subject to failure.

SUMMARY OF THE INVENTION

An objective of the present invention is to provide a ratchet with increased longevity while maintaining a labor saving purpose by the principle of leverage.

It another object to provide an improved ratchet wrench design.

Accordingly, the present invention is directed to a ratchet for rotating a threaded member. The ratchet includes an elongated member having a first end forming a handle and a second end, the second end including an open receiving surface therein. An insert is disposed within the open receiving surface and of a size smaller than the open receiving surface, wherein a portion of the open receiving surface includes a bearing surface against which the insert rotates, the insert configured for engaging the threaded member to enable rotation thereof.

A movable stop is also operably disposed within another portion of the open receiving surface adjacent the insert and the bearing surface in a manner such that when the insert is caused to rotate in one direction relative to the bearing surface the stop is frictionally drawn into lodging engagement with the insert and bearing surface to preclude further rotation of the insert and fixably secure relative position between the insert and the bearing surface whereby the rotation of the threaded member is effected, and when the insert is caused to rotate in an opposite direction, the stop is driven into a dislodged position.

In a preferred embodiment, the bearing surface extends partway along a perimeter of the open receiving surface against the insert, thereby leaving a portion of the perimeter contacting against the bearing surface and another portion out of contact with the bearing surface there being defined a first separation point between the bearing surface and the insert and a second separation point between the bearing surface and the insert. The stop is movable between a first position wherein the stop is disposed adjacent the first separation point and a second position wherein the stop is disposed adjacent the second separation point, the ratchet thus providing positive clockwise and counterclockwise rotation of the threaded member when switched between the two positions. The stop can be generally V-shaped.

DETAILED DESCRIPTION OF PREFERRED EMBODIMENT

Referring now to the present invention, the ratchet wrench of the present invention is generally referred to by the numeral 10 and 10' and except where parts differ between the two shown embodiments, like parts will have like numbers. The ratchet 10 will typically be described first, with the ratchet 10' being described subsequently where appropriate. The ratchet 10 includes a handle 12, which can be linear or bent, and a head 14 for engaging a head of a threaded member (not shown), such as a hex nut or head of a threaded bolt, for example. The ratchet 10' alternatively is shown having a bent or angled a handle 12'.

Figure 1:
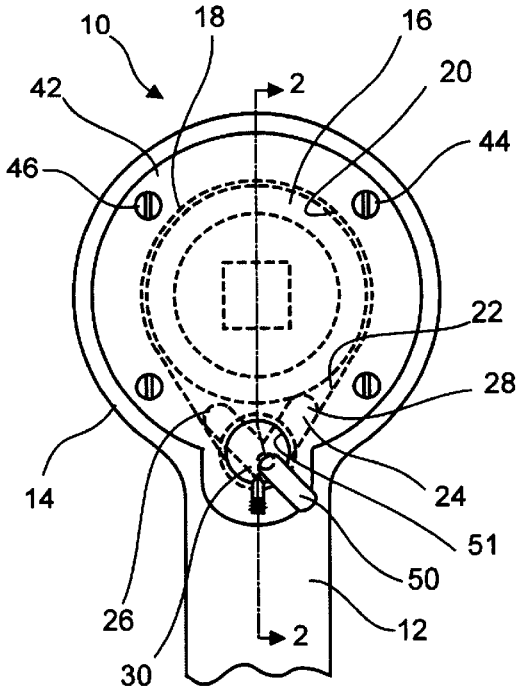
FIG. 1 is a view of one face of a ratchet head of the invention.
Figure 3:
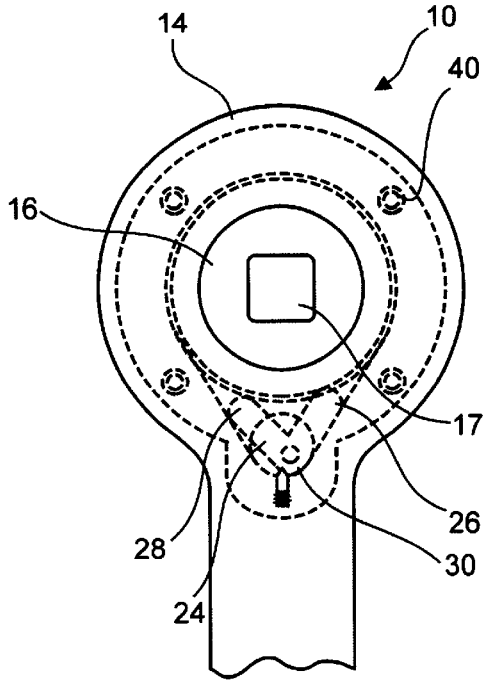
FIG. 3 is a view of another face pf the ratchet head of FIG. 1.
Figure 8:
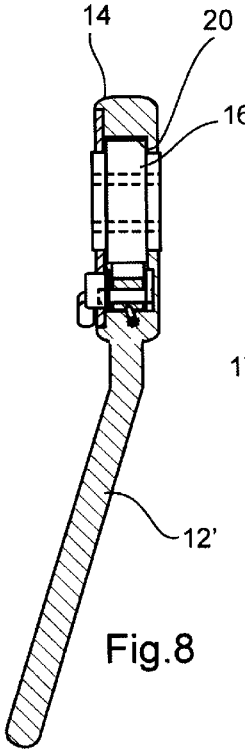
FIG. 8 is a side cross-sectional view of another embodiment of the ratchet of the present invention.
Figure 9:
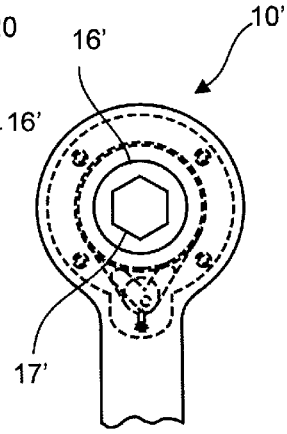
FIG. 9 shows a facial view of the ratchet head in FIG. 8.

In the embodiment shown in FIG. 1, an insert 16 is positioned within an open receiving surface 18 of the head 14. The head 14 is hollow with the receiving surface 18 therein. As seen in FIG. 1, the insert 16 is configured with a protruding portion 17 of the type known to connect to an adapter of a conventional socket not shown. Alternatively, as seen in FIGS. 8 and 9, the insert 16' may be formed with an open portion 17' configured to receive the head of a hex nut, for example.

The open receiving surface 18 includes a generally cylindrical portion 20 which serves as a bearing surface for the insert 16. Another portion 22 of the open receiving surface 18 is generally eccentric and receives a stop 24 therein. The open receiving surface 18 is shown here as generally teardropped shaped, yet it is recognized that other configurations may be employed to carry out the invention.

Figure 4:
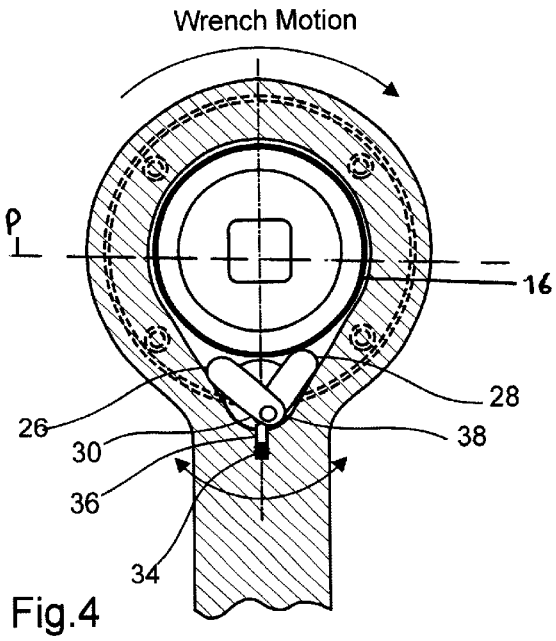
FIG. 4 is a face view depicting ratchet motion in one direction.

The stop 24 can be generally V-shaped as shown having two members 26 and 28 movably joined at one end by an arm pin 38 which extends through coaxial bores 27 and 29, respectively, of the members 26 and 28. The connected ends form a pivot point 30. The unconnected ends of the members 26 and 28 are characterized to have a hemi-cylindrical shape, either of which unconnected ends contacts a cylindrical outer bearing surface of the insert 16 along a single line of contact L perpendicular to a plane of rotation P of the ratchet head 14. For example, the connection between member 28 and insert 16 as seen in FIG. 4 forms line of contact L straight across the hemi-cylindrical end in a manner represented in FIG, 6. It is further contemplated that the stop 24 may take on other shapes to perform its intended purpose herein. The stop 24 can be coated with or formed with a friction enhancing surface to aid in its intended purpose.

Figure 2:
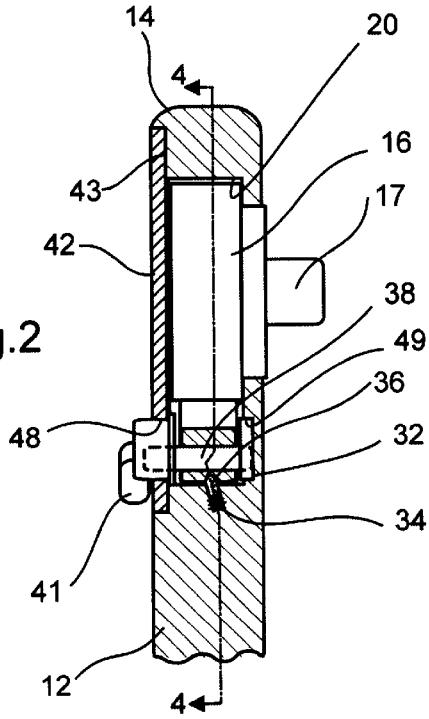
FIG. 2 is a cross sectional view of FIG. 1 through line 2—2.

Formed in the portion 22 and extending inwardly into the handle 12 is a bore 32 (see FIG. 2) which is set at an angle, by way of example, to ease the manufacturing process. A spring 34 and connected pin 36 are operably disposed in the bore 32 such that the spring 34 is inwardly positioned to bias outward against the pin 36. The pin 36 extends into the open receiving surface 18 in a manner to cause the pivot point 30 to take a position on one side or the other thereof The arm pin 38 extends outward from the stop 24 and is connected to a bearing 39 at one end and a lever 41 at another end. The bearing 39 is seated in a recessed surface 49 of the head 14. Through the use of the lever 41, the pin 38 is used to movably position the stop 24 from side to side with respect to an axis of the pin 36. Together, these components provide the means for maintaining engagement and disengagement between the unconnected ends of the members 26 and 28 and the insert 16 occurs along the line of contact in a manner to prevent binding therebetween.

Figure 5:
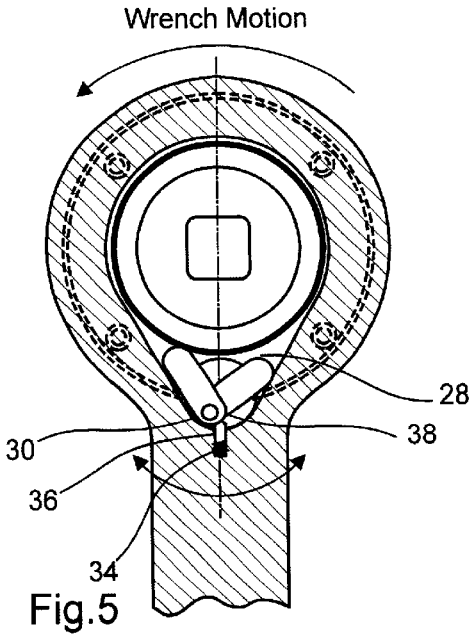
FIG. 5 is a face view depicting ratchet motion in an opposite direction.
Figure 6:
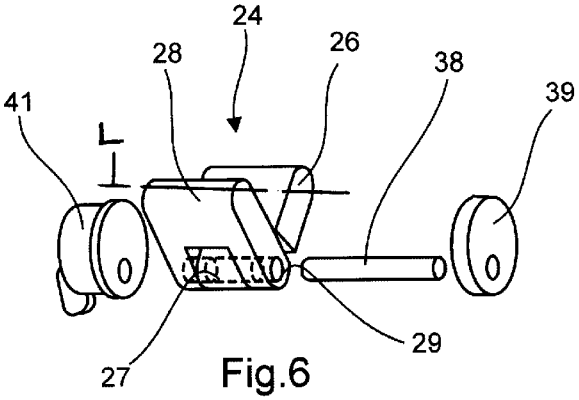
FIG. 6 is an exploded view of several components of the present invention.
Figure 7:
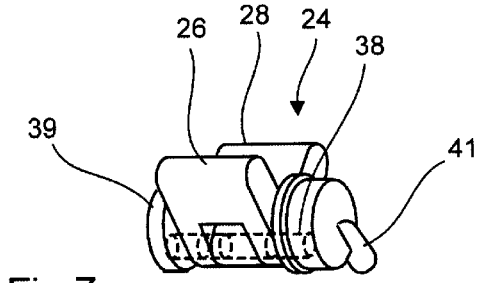
FIG. 7 shows a perspective of the components of FIG. 6 assembled.

A peripheral recessed collar 43 of the head 14 includes a plurality of threaded openings 40. A removable containment face plate 42 of a complementary configuration to the head 14 is connectable disposed in the recessed collar 43 on the head 14. The plate 42 includes coaxially aligned openings 44 through which set screws 46 extend and thread to the openings 40 thereby fixing the plate 42 to the head 14. The plate 42 further includes a slot 48 through which the arm 38 extends and can be actuated by lever 41 to move the stop 24. The ratchet wrench 10 shown in FIGS. 4 and 5 depict the motion required for operation thereof in which an engagement occurs with the stop 24. Reverse motion will disengage the stop 24.

What is claimed is:

1. A ratchet for rotating a threaded member, which comprises:

an elongated member having a first end forming a handle and a second end, said second end including an open receiving surface therein;

an insert having a generally cylindrical outer bearing surface disposed within said open receiving surface and of a size smaller than said open receiving surface, wherein a portion of said open receiving surface includes a partial cylindrical bearing surface against which said insert rotates, said insert configured for engaging the threaded member to enable rotation thereof;

a movable stop operably disposed within another bearing surface portion of said open receiving surface adjacent said insert, said stop including two members movably joined at one end by an arm pin and said members each having another end wherein each end is characterized to have a hemi-cylindrical shape such that when said insert is caused to rotate in one direction relative to said partial cylindrical bearing surface said stop is frictionally drawn into lodging engagement with said insert and said another bearing surface portion and wherein one of said ends contacts said cylindrical outer bearing surface of said insert along a single line of contact perpendicular to a plane of rotation of said insert to preclude further rotation of said insert and fixably secure relative position between said insert and said bearing surface whereby said rotation of the threaded member is effected, and when said insert is caused to rotate in an opposite direction, said stop is driven into a dislodged position; and means for maintaining engagement and disengagement between said end and said insert which occurs along said line of contact in a manner to prevent binding therebetween.

2. The ratchet of claim 1, wherein said insert is removably maintained within said open receiving surface.

3. The ratchet of claim 1, which includes means for causing at least one of said ends of said stop to remain in contact with said insert.

4. The ratchet of claim 3, wherein said causing means includes a spring loaded ball and detent mechanism.

5. The ratchet of claim 1, wherein said stop is characterized as generally V-shaped.

6. The ratchet of claim 1, wherein said stop includes a friction enhancing surface.

7. The ratchet of claim 1, wherein handle is bent.

* * * * *